US011254534B2

(12) United States Patent
Paolinelli et al.

(10) Patent No.: US 11,254,534 B2
(45) Date of Patent: Feb. 22, 2022

(54) UNWINDER FOR REELS AND UNWINDING METHOD

(71) Applicant: Fabio Perini S.P.A., Lucca (IT)

(72) Inventors: Alessio Paolinelli, Capannori (IT); Leonardo Boschi, Lucca (IT); Matteo Ricci, Lucca (IT)

(73) Assignee: FABIO PERINI S.P.A., Lucca (IT)

( * ) Notice: Subject to any disclaimer, the term of this patent is extended or adjusted under 35 U.S.C. 154(b) by 0 days.

(21) Appl. No.: 17/264,365

(22) PCT Filed: Jul. 26, 2019

(86) PCT No.: PCT/EP2019/070237

§ 371 (c)(1),
(2) Date: Jan. 29, 2021

(87) PCT Pub. No.: WO2020/025495

PCT Pub. Date: Feb. 6, 2020

(65) Prior Publication Data

US 2021/0245983 A1 Aug. 12, 2021

(30) Foreign Application Priority Data

Aug. 3, 2018 (IT) ..... 102018000007796

(51) Int. Cl.
*B65H 19/12* (2006.01)
*B65H 16/10* (2006.01)

(52) U.S. Cl.
CPC ..... *B65H 19/126* (2013.01); *B65H 16/106* (2013.01); *B65H 2301/41346* (2013.01); *B65H 2301/41468* (2013.01); *B65H 2404/20* (2013.01)

(58) Field of Classification Search
CPC ..... B65H 19/126; B65H 16/106; B65H 2301/41346; B65H 2404/20;
(Continued)

(56) References Cited

U.S. PATENT DOCUMENTS 3,740,296 A 6/1973 McDonald
4,676,494 A * 6/1987 Smith ..... B65H 16/02 270/30.04

(Continued)

FOREIGN PATENT DOCUMENTS

DE 1088339 B 9/1960
EP 0872440 A2 10/1998

(Continued)

*Primary Examiner* — William A. Rivera
(74) *Attorney, Agent, or Firm* — Breiner & Breiner, L.L.C.

(57) ABSTRACT

The unwinder includes a pair of tailstocks adapted to engage and support a reel to be unwound and a peripheral unwinding device adapted to coact with a reel in the unwinding station. There is also provided a shuttle adapted to insert reels into the unwinding station, movable between a loading position of the reel on the shuttle and a position aligned with the pair of tailstocks, to transfer a reel from the shuttle to the tailstocks or vice versa. In use, the peripheral unwinding device is positioned under the reel of web material, so that the force exerted by the peripheral unwinding device on the reel being unwound has a component that is subtracted from the weight force of the reel.

22 Claims, 15 Drawing Sheets

(58) Field of Classification Search
CPC ..... B65H 2301/41468; B65H 19/12; B65H 19/18; B65H 2301/46; B65H 18/10; B65H 18/22; B65H 2405/422
See application file for complete search history.

(56) References Cited

U.S. PATENT DOCUMENTS

| | | | | |
|---|---|---|---|---|
| 5,139,207 | A * | 8/1992 | Meschi | B65H 16/106 242/564.5 |
| 5,238,352 | A * | 8/1993 | Abe | B65H 19/126 104/35 |
| 5,261,618 | A * | 11/1993 | Meschi | B65H 16/106 242/563.2 |
| 5,901,918 | A * | 5/1999 | Klerelid | B65H 18/26 242/534 |
| 6,030,496 | A | 2/2000 | Baggot et al. | |
| 6,290,164 | B1 * | 9/2001 | O'Connor | B65H 19/126 242/471 |
| 6,679,451 | B1 | 1/2004 | Biagiotti | |
| 7,350,740 | B2 * | 4/2008 | Benvenuti | B65H 19/126 242/555.1 |
| 7,618,004 | B2 | 11/2009 | Gelli et al. | |
| 9,550,644 | B2 * | 1/2017 | Acciari | B65H 19/12 |
| 9,670,020 | B2 | 6/2017 | Morelli et al. | |
| 2002/0130214 | A1 * | 9/2002 | Nakamura | B65H 19/126 242/559.2 |
| 2006/0175457 | A1 * | 8/2006 | Benvenuti | B65H 19/126 242/552 |
| 2006/0226275 | A1 * | 10/2006 | Hada | B65H 16/106 242/564.5 |
| 2007/0102564 | A1 * | 5/2007 | Loffler | B65H 75/242 242/555.7 |
| 2014/0326822 | A1 * | 11/2014 | Morelli | B65H 16/106 242/555.3 |
| 2015/0034758 | A1 | 2/2015 | Acciari | |
| 2015/0121985 | A1 * | 5/2015 | Nunota | B65H 16/08 72/324 |
| 2020/0165091 | A1 * | 5/2020 | Techlin | B65H 18/10 |

FOREIGN PATENT DOCUMENTS

| | | | |
|---|---|---|---|
| EP | 1136406 | A2 | 9/2001 |
| EP | 1270470 | A2 | 1/2003 |
| EP | 1647509 | A2 | 4/2006 |
| WO | 9846509 | A1 | 10/1998 |
| WO | 2004080867 | A2 | 9/2004 |

* cited by examiner

UNWINDER FOR REELS AND UNWINDING METHOD

TECHNICAL FIELD

The invention relates to improvements to unwinders for unwinding reels of web material, for example in particular reels of tissue paper to feed web material to a line for converting web material and producing cellulose articles, such as rolls of tissue paper, packs of napkins or the like.

The invention also relates to a method for unwinding web material from an unwinding reel by means of an unwinder.

BACKGROUND ART

In some production lines that produce folded or wound sheet articles, for example cellulose articles, such as tissue paper or the like, it is required to unwind large diameter reels to feed a converting line, which carries out a series of operations on the unwound web material to obtain finished or semi-finished products, which in turn are further converted into finished products.

Typically, in the field of production of tissue paper articles, such as toilet paper, kitchen towels, napkins or the like, converting lines are used comprising one or more unwinders that feed one or more web materials, dispensed from respective reels being unwound, toward stations downstream that perform the converting operations. For example, one or more of the following units can be provided downstream of the unwinder: printing units, embossing units, rewinders, storage units, interfolding machines for the production of napkins, folding machines for the production of napkins or the like, packaging machines.

The large diameter reels that are unwound to feed the web material to the converting line must periodically be replaced when the web material wound thereon comes to an end, or when switching from the production of one type of article to another, for which a different type of web material is required. For this purpose, the unwinders are normally provided with reels replacement means. Due to the high productivity of the converting lines, it is necessary to replace the reels with a certain frequency, even every two hours. Therefore, it is useful to have a rapid, efficient and automated reel replacement system. Typically, systems and means are provided for removing the empty reel, or the rod on which it was formed, and replacing it with a new reel. Also known are unwinders with two or more unwinding stations, in which splicers automatically splice, with the machine at a standstill or on the fly, the web material from a reel that is coming to an end to the web material of a reel standing by.

Examples of unwinders for unwinding reels of web material, typically tissue paper, are described for example in U.S. Pat. Nos. 6,679,451, 7,618,004, 9,670,020, EP 1136406, EP 0975542, EP 1270470, EP 0872440.

In particular, EP0975542 and EP0872440 describe unwinders that comprise both central unwinding devices and peripheral unwinding devices. The latter comprise belts that act on the reel downwards from above. This increases the stress on the winding rod of the reel and on the tailstocks or punches that support them, resulting in mechanical problems.

WO 2004/080867 describes an automatic unwinder in which a reel is unwound through the combined use of a peripheral unwinding device and a central unwinding device. The reel that is coming to an end is lifted by motorized tailstocks forming part of the central unwinding device, to be subsequently transferred to removal means, placed in the upper part of the unwinding station. In this way, by means of a shuttle it is possible to insert a new reel into the unwinding station in front of the peripheral unwinding device. The central unwinding device is double, and has two pairs of tailstocks, so that while a first pair of tailstocks is in the upper position to complete unwinding of a reel that is coming to an end, a second pair of tailstocks can engage the new reel inserted by the shuttle and start to unwind it in combination with the peripheral unwinding device.

In the present context, a peripheral unwinding device is a device capable of imparting an unwinding torque, which rotates the reel of web material, through transmission of a friction force between a motor member and the substantially cylindrical outer surface of the reel.

Vice versa, a central unwinding device, in the sense meant herein, is a device that transmits an unwinding torque to the reel via its winding rod. Central unwinding devices normally comprise pairs of tailstocks, expansible or that can in any case engage with the central rod on which the reel is wound. At least one of the tailstocks is motorized to transmit a rotation motion to the winding rod of the reel.

The reels used in the paper converting industry are often very heavy. For example, it is possible to use reels with an axial length from two to five meters and a diameter of up to around three meters, with weights that can reach up to 5000 kg.

These reels are often handled inside the converting plant using bridge cranes or, in some cases, with fork-lift trucks provided with reel pick-up members. These members can be gripper members, which clamp the lateral surface of the reels. In other cases, the means for transporting and handling the reels comprise fork-lift trucks with pins that are inserted into the tubular winding rod placed at the center of the reels.

The unwinder used in a given converting line must be compatible with the loading means used to handle the reels and insert them into the unwinder or load them on a shuttle that, in turn, transports the reel to the unwinder. In view of the variety of the devices used to transport and handle the reels, it may be necessary to adapt an unwinder to the specific needs of the final user, resulting in costs for the design and/or adaptation of the unwinder. Moreover, to increase the level of automation of a production plant, the loading means often consist of autonomous vehicles, i.e., automatically guided vehicles, with which it is preferable to associate an unwinder that allows the reel to be loaded automatically without the need for personnel and hence without using a bridge crane and devices to engage the tubular winding rod of the reel with the arms of the bridge crane.

SUMMARY

According to one aspect, there is provided an unwinder of reels of web material having at least one unwinding station comprising a pair of tailstocks adapted to engage and support a reel to be unwound, combined with a peripheral unwinding device adapted to co-act with a reel in said unwinding station. The unwinder further comprises a shuttle adapted to insert reels into the unwinding station. The shuttle is movable between a loading position of the reel on the shuttle and a position aligned with the pair of tailstocks. In the latter position the shuttle can transfer a reel from the shuttle to the tailstocks, or transfer an empty reel, or its winding rod, from the tailstocks to the shuttle. Advantageously, the peripheral unwinding device is arranged so that, in use, i.e., when it acts on the reel engaged by the tailstocks to rotate it and unwind the web material, said peripheral unwinding device is positioned under the reel of web material. In this way, the force exerted by the peripheral unwinding device on the reel being unwound (force that allows torque to be transmitted from the unwinding device to the reel as a result of friction) has a component that is subtracted from the weight force of the reel.

With this arrangement, in a shuttle unwinder, which allows high performances and a high level of automation during reel change to be reached, the advantage is achieved of reducing the mechanical stress on the tailstocks and on the winding rod of the reels engaged by the tailstocks. In this way, the risks of the rods breaking and the tailstocks being damaged due to overloading are reduced. This is particularly important in the case of motorized tailstocks, i.e., in the case in which the unwinder has a central unwinding system that works in combination (or can work in combination) with the peripheral unwinding system.

In advantageous embodiments, the peripheral unwinding device is movable between an active position, wherein it co-acts with a reel engaged by the tailstocks, and a position withdrawn with respect to the tailstocks. When the peripheral unwinding device is in the withdrawn position, a space is created to insert the shuttle easily in front of or between the tailstocks and thereby carry out the operations to unload and remove the empty reel (or its winding rod), and the operations to insert and load a new reel.

The detailed description of embodiments will describe a particularly advantageous configuration of the peripheral unwinding device which moves from the active position to the withdrawn position with a translation movement parallel to the orientation of the axes of the tailstocks, and hence parallel to the direction of the axis of the reel when it is engaged with the tailstocks. In other embodiments it would also be possible to move the peripheral unwinding device in different ways and directions. For example, the peripheral unwinding device can be translated in a horizontal direction orthogonal to the axis of the tailstocks, or in a vertical direction orthogonal to the axis of the tailstocks. For example, in the case of a double unwinder with symmetrical arrangement of two pairs of tailstocks and related peripheral unwinding devices and shuttles, a splicing zone of web materials coming from the two reels in the two unwinding stations can be arranged between the two pairs of tailstocks. The space for a withdrawn position of one or the other of the two opposite and symmetrical peripheral unwinding devices can be obtained in the zone in which the splicer is arranged.

In advantageous embodiments, in particular when the peripheral unwinding device is movable parallel to the axis of the tailstocks, in the active position the peripheral unwinding device is in an intermediate position between the tailstocks, and in the withdrawn position the peripheral unwinding device is staggered laterally, in the direction of the rotation axes of the tailstocks, with respect to said tailstocks.

In advantageous embodiments the shuttle and the peripheral unwinding device are movable in the same direction, preferably in the direction of the axis of the tailstocks. Preferably, the loading position of the shuttle and the withdrawn position of the peripheral unwinding device are on opposite sides of the unwinding station. In this case, it is advisable and particularly advantageous for the shuttle and the peripheral unwinding device to be movable along a common guide system, to reduce the overall dimensions, the number of components and consequently the cost of the unwinder.

In particularly advantageous embodiments, one or both the tailstocks can be motorized. In this case, the tailstocks define a central unwinding device. The reels can in this way be unwound applying an unwinding torque through the combined effect of the peripheral unwinding device and of the central unwinding device. In this case, activation of one or the other or of both the unwinding devices (peripheral and central) can depend on various factors, among which the quality of the web material wound on the reel, the winding density, the dimension of the reel, etc. For example, it is also possible to activate and/or deactivate one or the other of the two unwinding devices (peripheral and central) in different stages of unwinding of the same reel, for example as a function of the diameter of the reel, or also as a function of the production speed, i.e. of the speed at which the web material must be unwound from the reel and fed to the converting line.

Advantageously, although it would be possible to arrange handling means for handling the reels and the winding rods on the shuttle, so that the tailstocks can remain in a fixed position with respect to the structure of the unwinder, it is preferable for the tailstocks to be movable between at least a position for picking up the reel from the shuttle and an unwinding position. The movement can be supplied, for example, by a pair of carriages or slides provided with a motion according to translation axes incident with each other. Preferably, for simpler construction and greater efficiency, the tailstocks can be supported by rotating arms, i.e., arms pivoted to a fixed structure, to rotate about an axis substantially parallel to the axis of the tailstocks. The shuttle can be provided with a cradle optionally movable in a direction of translation, for example a horizontal direction, to move toward and away from the rotation axis of the arms that support the tailstocks. This can provide particularly advantageous functions, as will be described with reference to an embodiment.

Although in principle the unwinder can have a single unwinding station, with a pair of tailstocks and a peripheral unwinding device, for greater efficiency and greater speeds during replacement of the reels, it is advantageous for the unwinder to comprise two unwinding stations, preferably the same as, or symmetrical to, each other. In this case a splicing zone can be arranged between the two substantially symmetrical stations, in which a splicer is positioned to splice the web material of a reel in one of the two unwinding stations to the web material of a reel in the other of the two unwinding stations. With two unwinding stations and a splicer it is possible to carry out operations to change or replace an empty reel with a new reel on the fly.

Further advantageous features and embodiments of the unwinder are defined hereunder and in the appended claims.

According to a further aspect, there is described a method for unwinding web material from a reel being unwound in an unwinding station, in particular with an unwinder as defined above, comprising the steps of:

- dispensing the web material from the reel being unwound engaged by a pair of tailstocks, maintaining the reel in rotation at least by means of a peripheral unwinding device in contact with the lateral surface of the reel being unwound and positioned under the reel, so as to apply on the reel a resultant force with a component opposing the weight force of the reel;
- when the reel being unwound requires to be replaced, taking the reel out of contact with respect to the peripheral unwinding device;
- arranging a shuttle between the tailstocks;

unloading the reel or a winding rod thereof from the tailstocks onto the shuttle;

moving the shuttle away from the tailstocks;

removing the empty reel or its rod from the shuttle;

loading a new reel onto the shuttle;

translating the shuttle in front of the tailstocks;

engaging the new reel with the tailstocks;

lifting with the tailstocks the new reel from the shuttle;

moving the shuttle away from the tailstocks;

taking the new reel into peripheral contact with the peripheral unwinding device.

Further advantageous features and embodiments of the method described herein are illustrated hereunder and in the appended claims.

BRIEF DESCRIPTION OF THE DRAWINGS

Embodiments of an unwinder described herein will be illustrated hereunder with reference to the accompanying drawings, wherein.

DETAILED DESCRIPTION OF EMBODIMENTS

In brief, the unwinder described herein comprises one and preferably two unwinding stations, in which respective reels of web material to be dispensed to a converting line are arranged. The use of two unwinding stations allows a first reel to be unwound in one of the two unwinding stations, while a second new reel is prepared in the other unwinding station. When the first reel is empty, or must in any case be replaced, the leading edge of the web material of the second reel is spliced to the web material of the first reel, which is usually cut to create a trailing edge. In this way the web material, coming from reels that are replaced as they come to an end, is fed continuously.

Each unwinding station comprises a peripheral unwinding device and advantageously can comprise a central unwinding device. When the reel must be replaced, because it is empty or for any other reason, it is lifted from the peripheral unwinding device, to allow the latter to translate to a withdrawn, i.e., inactive, position and leave free space in front of the reel to be replaced. Lifting can be carried out through tailstocks, for example belonging to a central unwinding device, which engage the ends of a central rod on which the web material forming the reel is wound. In this way, a shuttle can be positioned under the reel to be replaced. The shuttle is used to receive the empty reel, or the rod on which it is wound, and transfer the remainder of the reel, or the winding rod thereof, into a position in which it is picked up by an operator. In the same position the shuttle can receive a new reel, which is then transferred thereby in front of the unwinding position to be engaged by the tailstocks. Once the new reel is engaged by the tailstocks and has been lifted from the shuttle, the shuttle is translated to a lateral position to leave room once again for the peripheral unwinding device, which is re-positioned at the new reel.

As will be apparent from the detailed description of embodiments with reference to the accompanying drawings, with the unwinder as configured above, a series of advantages are possible with respect to prior art unwinders, in particular in terms of rapidity of the operations to replace empty reels, of flexibility in handling of the reels and of reliability.

Figure 1:
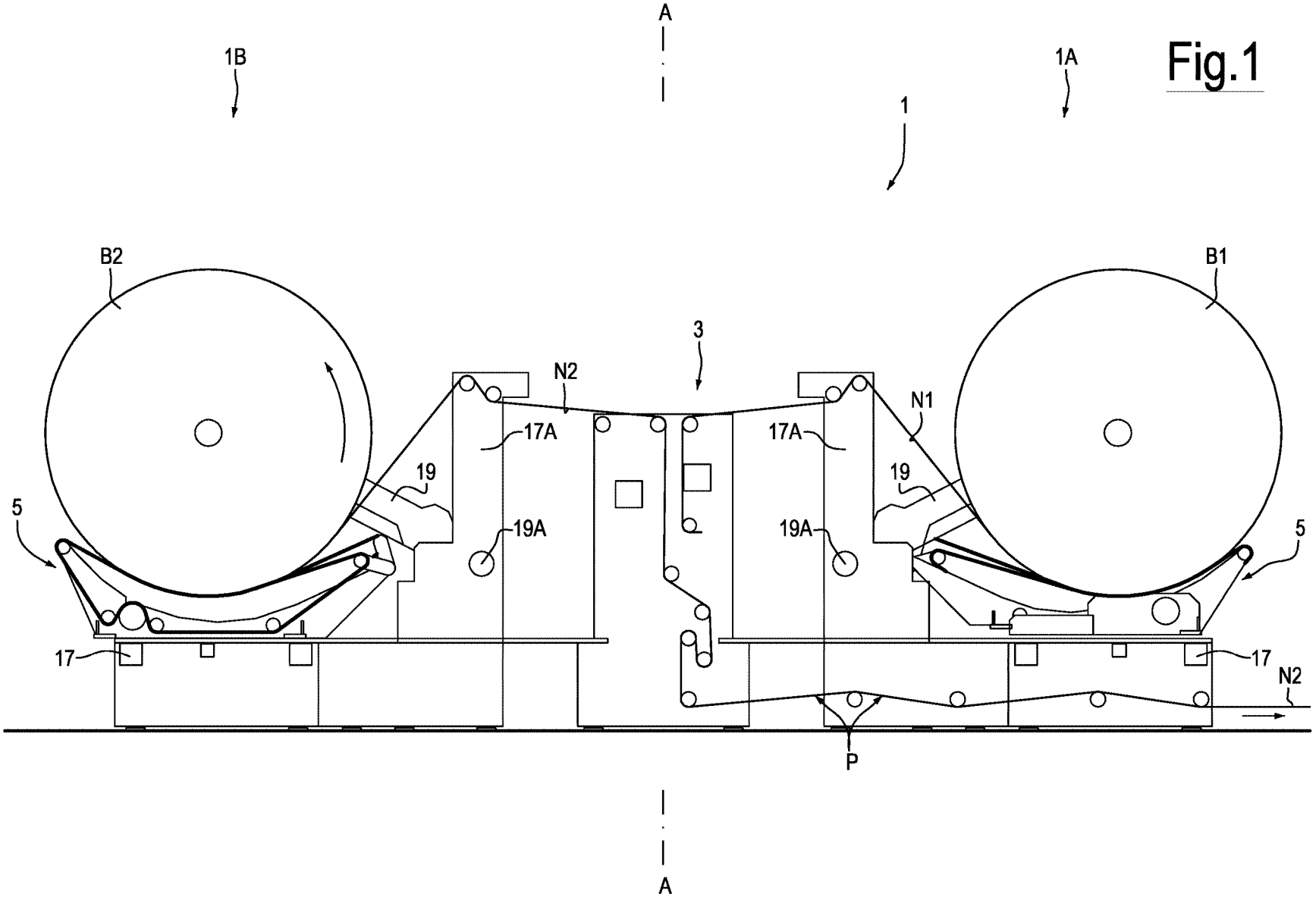
FIG. 1 shows a side view of an unwinder according to one embodiment.
Figure 2:
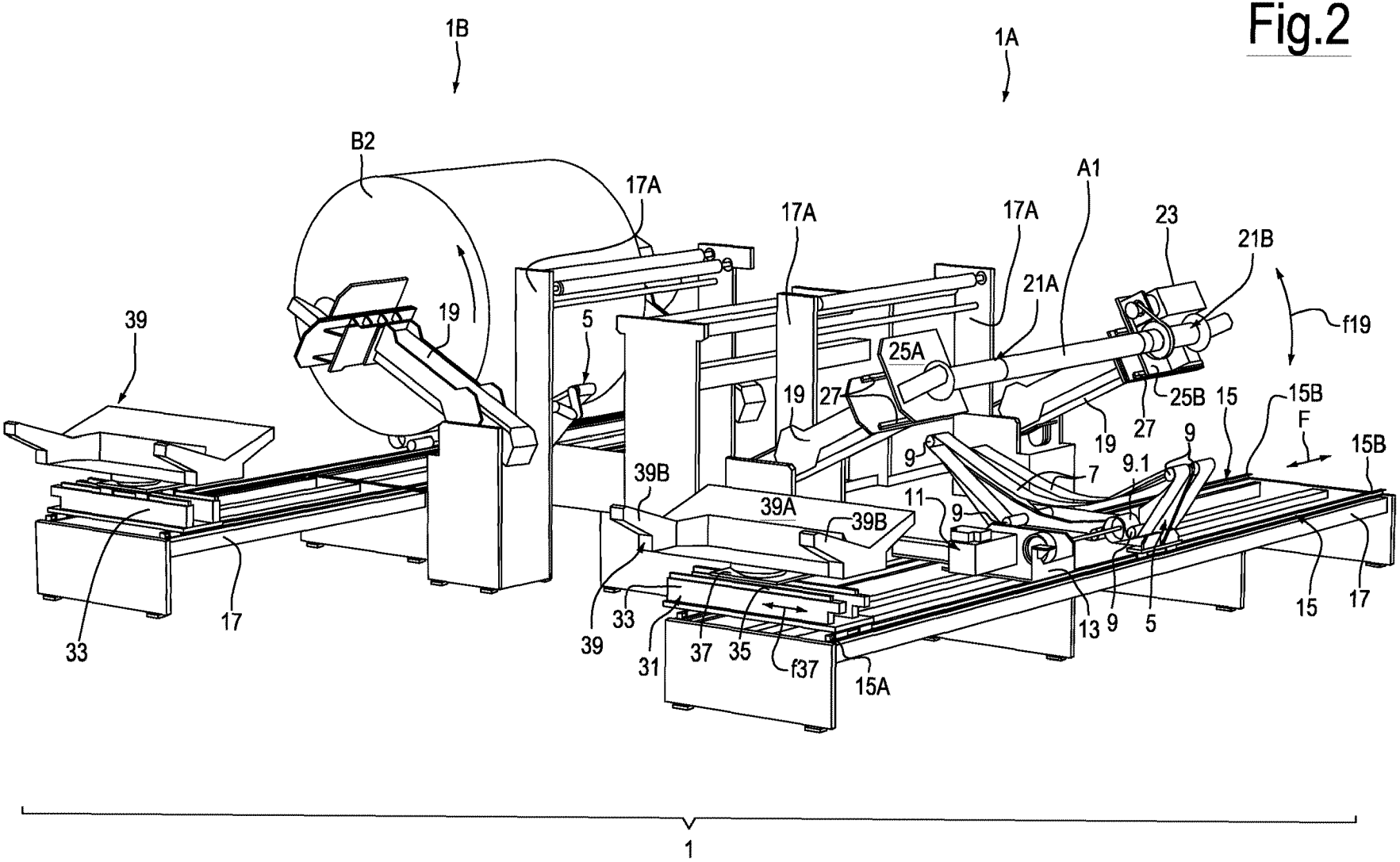
FIGS. 2 to 15 show axonometric views of the unwinder of FIG. 1 in different positions of a cycle to replace an empty reel with a new reel.

With regard to the drawings, with particular reference to FIGS. 1 and 2, the main components of an unwinder will be illustrated. FIG. 1 illustrates a lateral view of the unwinder with two stations, with two reels (one being unwound and one standing by) inserted into the two unwinding stations. FIG. 2 shows an axonometric view of the unwinder in a condition in which one reel is empty and must be replaced with a new reel, while the other reel is being unwound.

The unwinder illustrated in the accompanying drawings is indicated as a whole with 1 and comprises two unwinding stations 1A and 1B. The unwinding stations 1A and 1B are substantially symmetrical with respect to a vertical line A-A (FIG. 1). In the layout of FIG. 1, a reel B1 on which a web material N1 is wound is located in the unwinding station 1A, while a second reel B2 on which the web material N2 is wound is positioned in the unwinding station 1B. In the particular condition of FIG. 1, the reel B2 is being unwound and the web material N2 is fed along a path P toward stations downstream of the unwinder, not shown, belonging to a converting line. In the embodiment described herein a large portion of the path P extends under the level at which the other members of the unwinder 1 are located, so as not to hinder the operations of personnel. This arrangement also enables a reduction in the vertical dimension of the unwinder, and prevents paper dust from falling from above.

Again with reference to the layout in FIG. 1, the reel B1 is standing by and the leading edge of the web material N1 is retained inside a splicer indicated as a whole with 3, which is in an intermediate position between the unwinding station 1A and the unwinding station 1B. The splicer 3 can be of know type, for example it can be designed as described in U.S. Pat. No. 7,618,004. The purpose of the splicer 3 is to splice the web material of a reel that is coming to an end to the initial part of the web material of a reel standing by. Splicing can be carried out on the fly, i.e., without completely stopping the feed of the web material. This guarantees more regular operation of the converting line downstream, and greater productivity.

As the two unwinding stations 1A and 1B are symmetrical, hereinafter reference will be made only to the unwinding station 1A, of which the various components will be described. These are positioned symmetrically in the unwinding station 1B.

The unwinding station 1A comprises a peripheral unwinding device 5. The peripheral unwinding device 5 comprises in general members adapted to transmit an unwinding torque to the reel through friction by means of contact of unwinding members with the peripheral cylindrical surface of the reel. In the embodiment illustrated, the peripheral unwinding device 5 comprises a pair of endless unwinding belts 7, entrained around a plurality of guide rollers 9. One of these rollers, indicated with 9.1, for each belt 7 is motorized, for example by means of a motor 11.

The guide rollers 9, 9.1, the motor 11 and the belts 7 are mounted on a movable unit, hereinafter indicated as slide 13. The slide 13 is movable according to the direction F along a guide system comprising for example two guides 15 parallel to each other. The guides 15 are for example fixed to a load bearing structure 17. The guides 15 extend transversely through the unwinding station 1A and can extend from a first end 15A to a second end 15B. The ends 15A and 15B are on opposite sides of the unwinding station 1A. The guides 15 and hence the direction F of movement of the slide 13 are parallel to the axis of rotation of a reel when this is located in the unwinding station 1A.

The load bearing structure 17 can have uprights 17A, to which supporting members of a central unwinding device can be mounted. The uprights 17A are arranged in an approximately intermediate zone of the transverse extension of the unwinding station 1A, and therefore between the ends 15A and 15B of the guides 15.

In the embodiment shown, rotating arms 19 are hinged to the uprights 17A. The arms 19 can rotate according to the double arrow f19 about a horizontal axis 19A, see in particular FIG. 1. The rotation movement of the arms 19 is synchronous and can be controlled by one or two distinct actuators, not shown, for example in the form of electric or hydraulic motors. The trajectories of the two rotating arms 19 define an intermediate volume between the two arms, in which the reel to be unwound is positioned.

Each one of the two arms 19 supports, at the distal ends thereof, i.e., the end farthest from the axis of rotation 19A, a respective tailstock indicated with 21A and 21B, respectively for the two arms 19. The two tailstocks 21A, 21B can be symmetrical or different with respect to one another. In the example illustrated the two tailstocks 21A, 21B are slightly different with respect to one another, as only one is motorized, as described below. The assembly of tailstocks 21A, 21B forms a central unwinding device, i.e., which imparts an unwinding torque on the winding axis of the reel B1 or B2.

The rotating arms 19 are movable synchronously about the rotation axis 19A, so that the tailstocks 21A, 21B can remain axially aligned to one another.

The tailstocks 21A, 21B rotate about a respective rotation axis parallel to the rotation axis 19A of the rotating arms 19.

In the embodiment shown, the tailstock 21B is motorized by means of a motor 23, while the tailstock 21A is idle. In other embodiments, not shown, both the tailstocks 21A, 21B can be motorized, with respective motors 23 maintained synchronized through an appropriate electronic control.

The tailstocks 21A, 21B are movable along their axis of rotation, to move toward and away from each other. For example, in some embodiments the tailstocks 21A, 21B can each be supported on a respective carriage or slide 25A, 25B. The slides 25A, 25B can be movable along guides 27 integral with the arms 19. Actuators, not shown, can control the translation movement of the slides 25A, 25B along the guides 27. Said guides 27 extend parallel to the guides 15 and allow the two tailstocks to move in an axial direction according to the double arrow f21. In this way, the tailstocks 21A, 21B can move toward and away from each other in the direction of the axis of the reel arranged in the unwinding station 1A.

In advantageous embodiments, as shown in the drawings, the unwinding belts 7 are positioned below the axis of the reel, so that the force exerted thereby on the lateral surface of the reel is not added to the weight, but rather subtracted from the weight of the reel. In substance, the belts can support the reel being unwound from below to above, so as to reduce the mechanical load on the arms 19 and on the tailstocks 21A, 21B. In this way, the bending load that acts on the winding rod of the reel is also reduced, thereby reducing the risk of breakage and/or malfunctioning. The eccentricity of the reel is also reduced as a result of the lower bending deformation. In general, the configuration of the belts 7 is such that the resultant force applied thereby to the reel has at least one component facing upward, i.e., so that the weight force that is discharged onto the tailstocks 21A, 21B is reduced.

Each unwinding station 1A, 1B comprises a shuttle indicated as a whole with 31. As will be more apparent from the description below, the shuttle 31 has the function of removing the winding rods of the empty reels and of inserting the new reels in the correct position between the tailstocks 21A, 21B. In the embodiment shown, the shuttle 31 of each unwinding station 1A, 1B is movable along the same direction F along which the peripheral unwinding device 5 moves. For this purpose, the shuttle 31 can be mounted sliding on the same guides 15, although it would also be possible to provide different guides for the peripheral unwinding device 5, or more specifically for its slide 13, and for a shuttle 31. The use of common guides makes the overall architecture simpler, more compact and less expensive.

In the embodiment shown, the shuttle 31 comprises a slide or carriage 33, equipped with shoes that engage with the guides 15. In the embodiment shown, the carriage 33 in turn supports a pair of guides 35 oriented at 90° with respect to the guides 15. A slide 37 is mounted sliding on the guides 35 and is movable along the guides 35 according to the double arrow f37. A cradle 39, configured with a V-shaped surface that receives the reels and the winding rods of the empty reels, to transfer them toward and away from unwinding members of the unwinding station, is mounted on the slide 37. In some embodiments, the cradle 39 is mounted so as to be able to rotate with respect to the slide 37 on which it is mounted, for example by 90°, about a vertical axis C-C.

In some embodiments, the cradle 39 has a continuous surface 39A defining one side of the cradle and two arms 39B defining the other side of the cradle. An empty space is left between the arms 39B to facilitate movement of the cradle 39 toward the reels loading and handling means, for example means that have external jaws to engage the reels on their outer cylindrical surfaces. The arms 39B and the surface 39A form a V-shaped cradle.

Having described the main components of the unwinder 1 and of its unwinding stations 1A, 1B, an operating cycle for the replacement of an empty reel with a new reel will now be described with reference to the sequence of FIGS. 2 to 15. FIGS. 2 to 15 show the same axonometric view of the unwinder 1 in various instants of the operating cycle.

In FIG. 2 a reel B2 that is supported by the arms 19 and engaged by the respective tailstocks 21A, 21B is located in the unwinding station 1B. The reel B2 is in contact with the belts 7 of the respective peripheral unwinding device 5. The combination of the tailstocks 21A, 21B (forming a central unwinding device) and of the belts 7 of the peripheral unwinding device imparts to the reel B2 a torque that maintains it in rotation about the axis of the tailstocks, to unwind and dispense the web material wound thereon toward the stations downstream (not shown). For clarity of representation, the web material N2, visible in FIG. 1, is not shown in FIG. 2 and following.

Again with reference to FIG. 2, in the unwinding station 1A a winding rod A1 on which the web material N1 of a reel B1 was wound is engaged between the tailstocks 21A, 21B (FIG. 1). In FIG. 2 the reel B1 is empty and the tailstocks 21A, 21B are only supporting the winding rod A1 that must be removed from the unwinding station 1A and replaced with a new reel. In other situations, the reel B1 may not be completely empty at the time in which its replacement is required, or there may still be some residual web material N1 around the winding rod A1.

In the layout of FIG. 2 the shuttle 31 is on one side of the unwinding station 1A, in a loading and unloading position, at one end of the guides 15 and more specifically at the end 15A of the guides. Vice-versa, in this step the peripheral unwinding device 5 is in an intermediate position between the arms 19, in front of the position in which the reel wound on the rod A1, now empty, was located.

Figure 3:
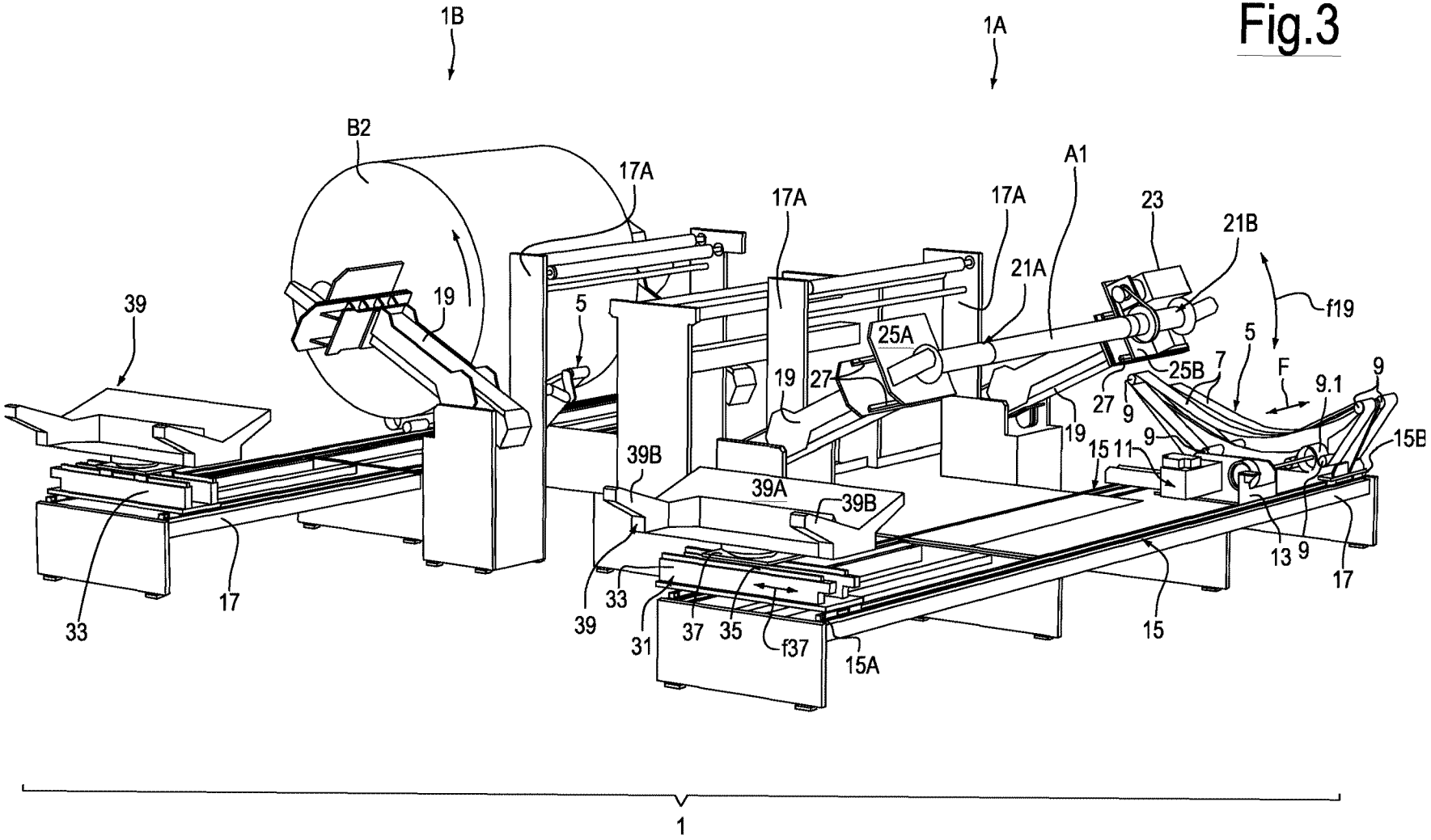

FIG. 3 shows the next step, in which the peripheral unwinding device 5 has been translated from the intermediate position, between the arms 19 and the tailstocks 21A, 21B, to a withdrawn position substantially at the end 15B of the guides 15, on the side of the unwinding station 1A opposite the side on which, in this step, the shuttle 31 is located. In this way the space in front of the arms 19 and under the winding rod A1 has been cleared, to allow entry of the shuttle 31.

Figure 4:
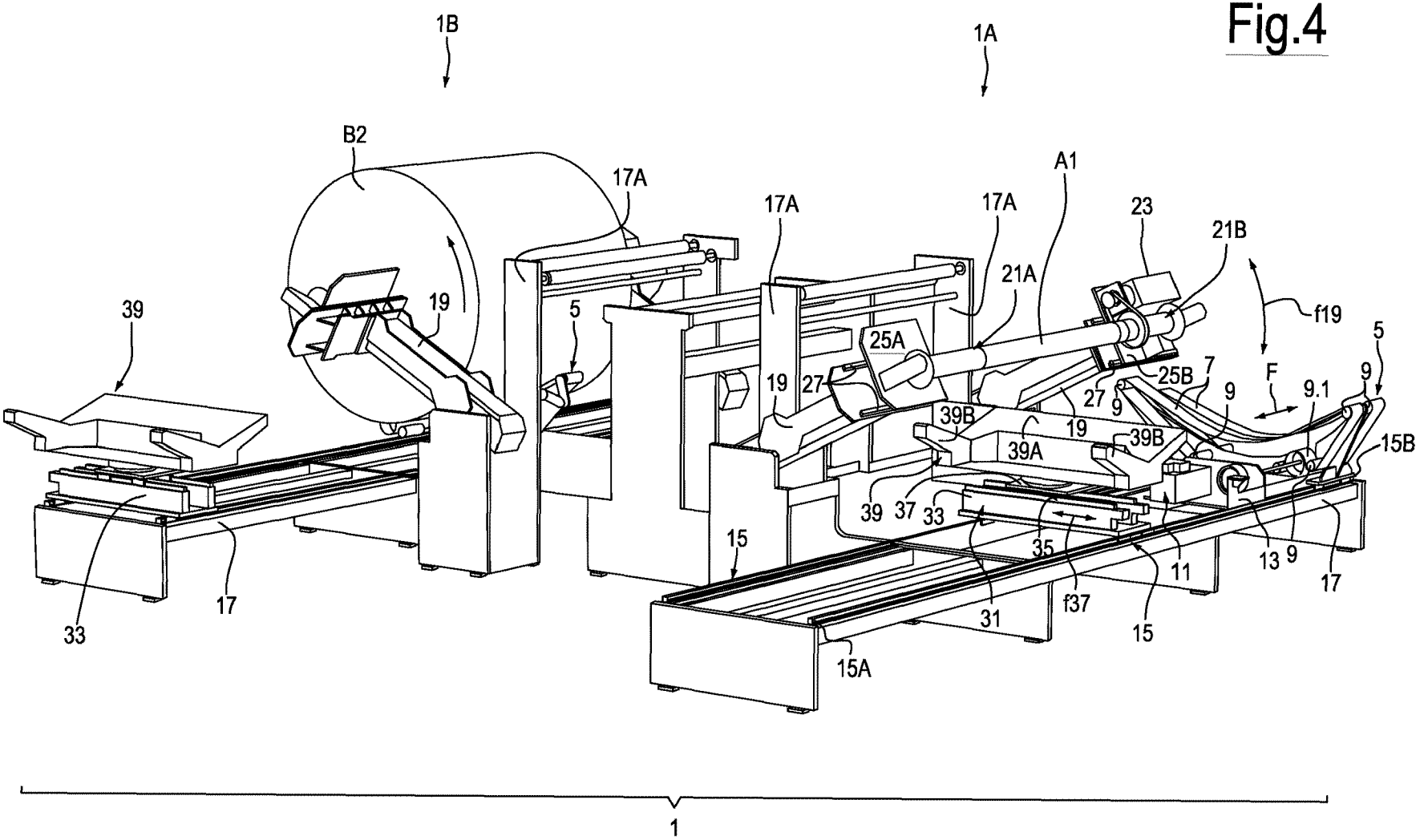

FIG. 4 shows the next step, in which the shuttle 31 has been translated from the lateral loading and unloading position at the end 15A of the guides 15 to an intermediate position along said guides, between the arms 19 and under the winding rod A1 to be removed. This movement is made possible in that the peripheral unwinding device 5 has been previously withdrawn from the position of the tailstocks 21A, 21B and advantageously taken to the side of the unwinding station 1A opposite the side on which the shuttle 31 is located.

Figure 5:
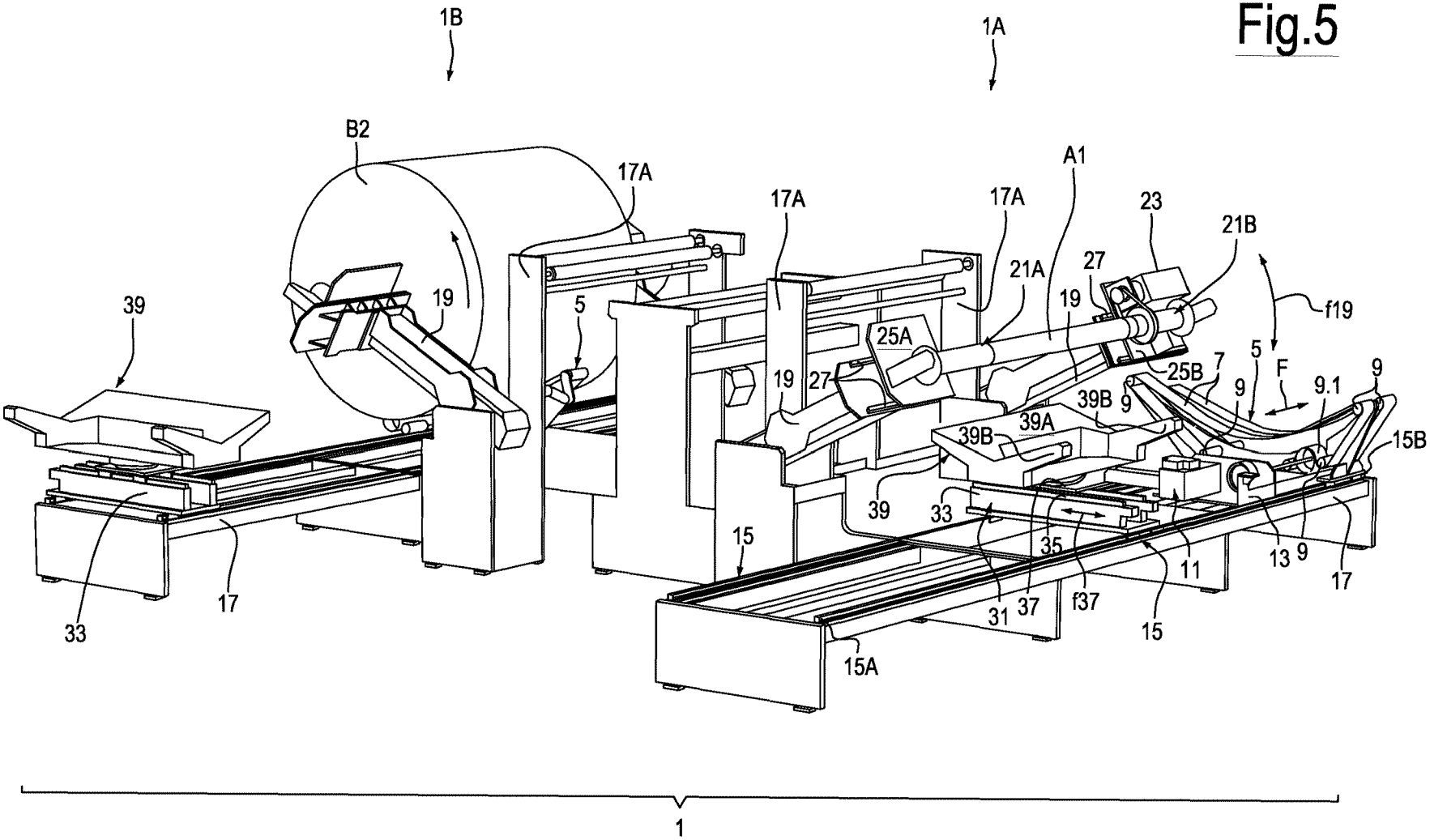

FIG. 5 shows the next step, in which the cradle 39 of the shuttle 31 has been rotated by 90° about the vertical axis C-C, to take the cradle 39 to the correct orientation to receive the rod A1 of the empty reel. In substance, the cradle 39 has been rotated to take the vertex of the "V" formed thereby into a position parallel to the axis of the winding rod A1, coincident in this step with the axis of rotation of the tailstocks 21A, 21B. The cradle 39 is positioned correctly, i.e., so as to receive the winding rod A1 directly on the vertex of the cradle 39 as a result of the movements according to the arrows f37 and F, which allow the cradle 39 to be moved on a Cartesian plane. In this way the cradle 39 is always positioned correctly as a function of the dimension of the winding rod A1 and of any residual web material N1 wound on the winding rod A1.

Figure 6:
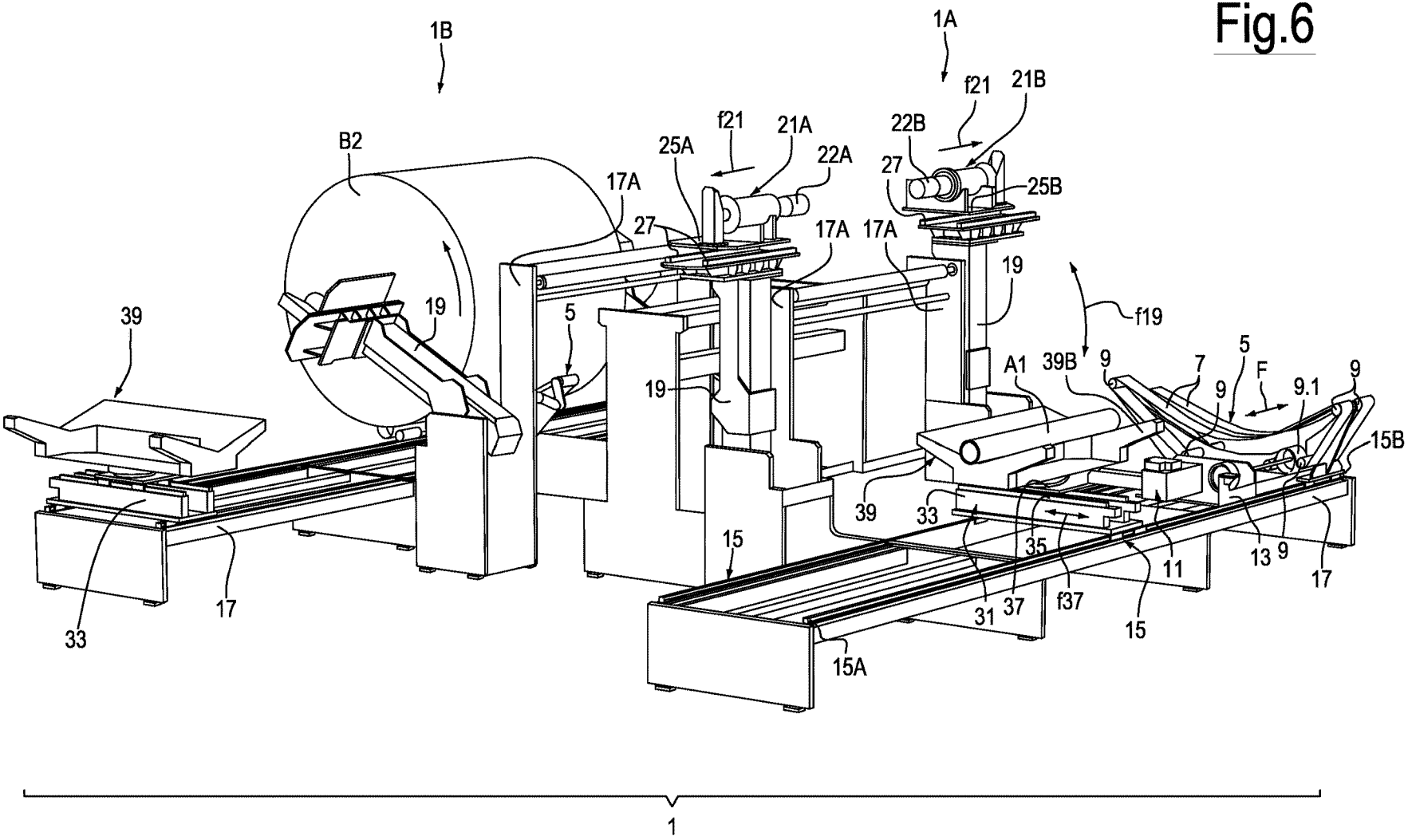

Subsequently (FIG. 6) the winding rod A1 is placed on the cradle 39 of the shuttle 31 lowering the tailstocks 21A, 21B by means of a downward rotation (arrow f19) of the arms 19. In FIG. 6 the rod A1 is shown after its release by the tailstocks 21A, 21B. After release of the winding rod, the rotating arms 19 can be taken, with a rotation movement in the opposite direction to the previous one, to a vertical position or in any case so as to move the tailstocks 21A, 21B further from the zone in which the shuttle 31 is located, to make room for the new reel to be inserted in the next steps.

FIG. 6 shows how each tailstock 21A, 21B has torsional coupling members 22A, 22B that, in the example illustrated, are inserted into the winding rod A1 of each reel and expand to provide a torsional coupling between tailstocks 21A, 21B and winding rod A1 and in this way transmit the rotation motion, imparted by the motor 23, from the tailstocks (or from the single motorized tailstock) to the reel formed around the winding rod engaged by the torsional coupling members 22A, 22B.

To release the winding rod A1 on the cradle 39 of the shuttle 31, the embodiment illustrated provides for a first retraction movement of the torsional coupling members 22A, 22B and a subsequent refraction movement of the tailstocks 21A, 21B according to the arrow f21, so as to extract the torsional coupling members 22A, 22B from inside the winding rod A1.

Other embodiments can provide for winding rods that project from the respective reel and that can be engaged with the torsional coupling members 22A, 22B in another way, for example through external clamping of portions of the winding rod A1 projecting from the reel formed around it.

Figure 7:
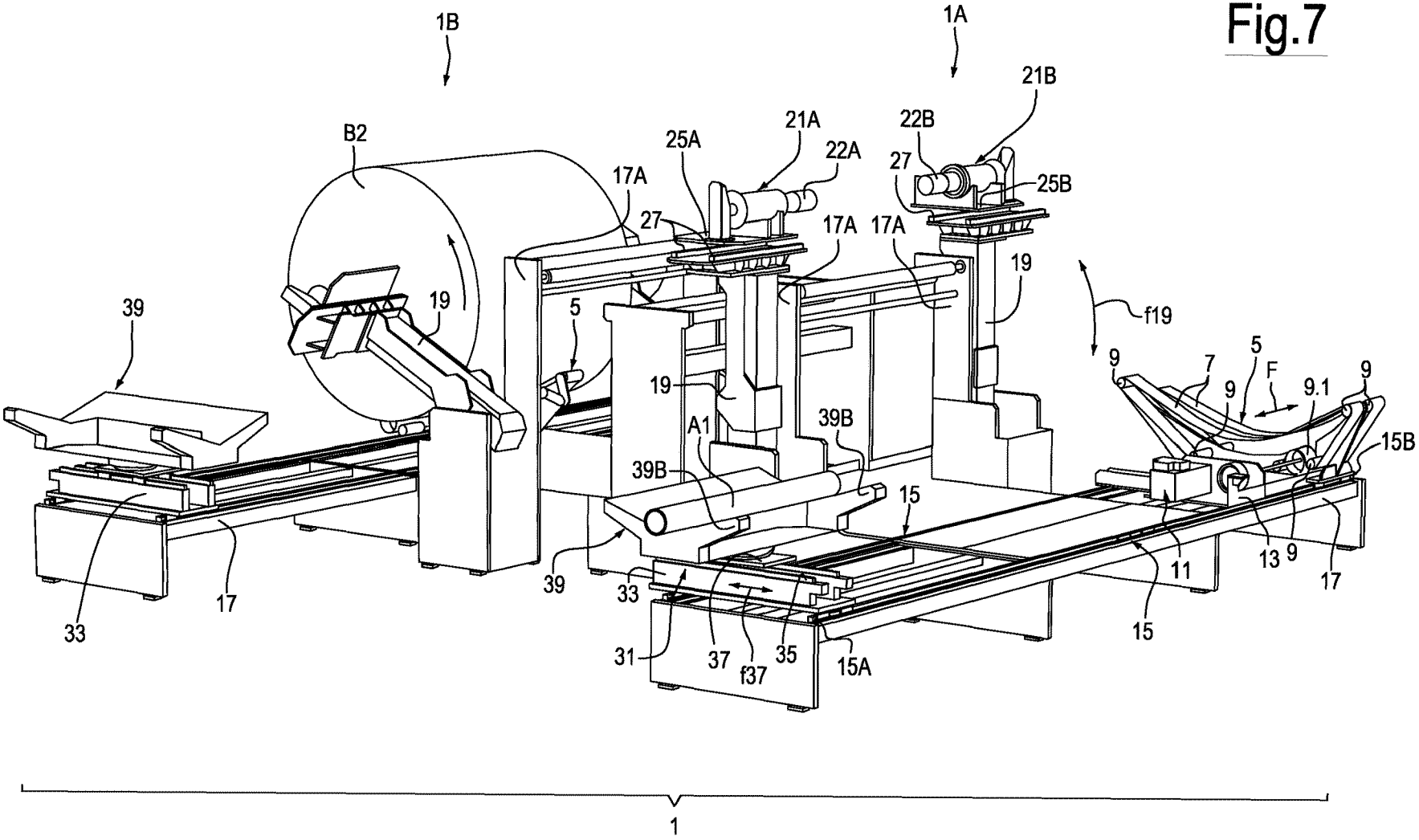

FIG. 7 shows the subsequent step, in which the shuttle 31 has been moved from the central or intermediate position, where it received the rod A1, to the lateral loading and unloading position at the end 15A of the guides 15, on the side of the unwinding station 1A.

Figure 8:
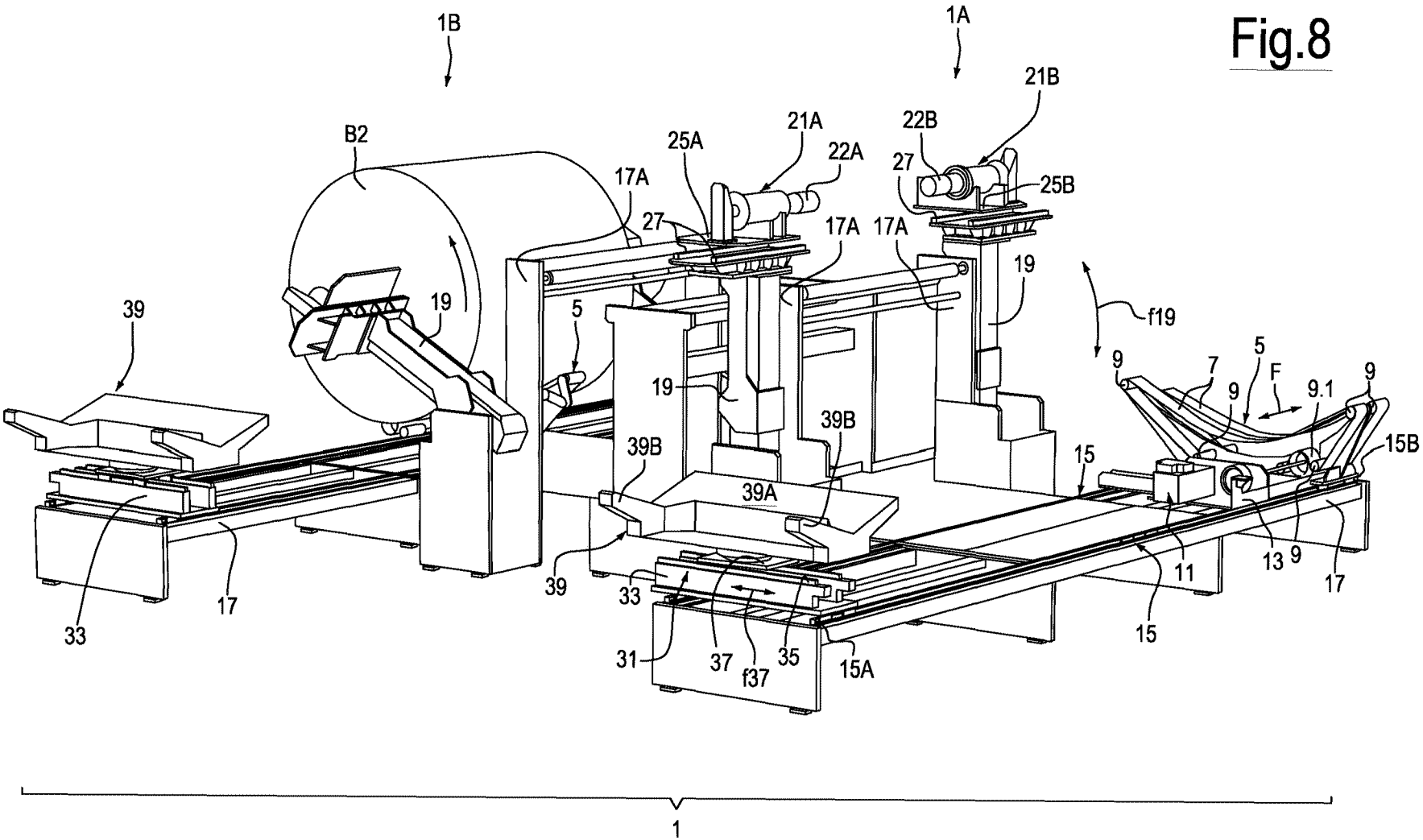

In FIG. 8 the cradle 39 of the shuttle 31 has been rotated by 90° to take the rod A1 to the position orthogonal to the guides 15 and allows removal thereof by means, not shown. In FIG. 8 the rod A1 has already been removed from the cradle 39 of the shuttle 31.

In the embodiment illustrated, the arms 19 are stopped in their vertical position. However, it must be understood that the upward rotation movement of the arms 19 can also be postponed with respect to what is illustrated in the sequence described and that the stand-by position of the arms 19 may not be perfectly vertical, but for example rotated further downward, as a function of the diameter of the new reel to be loaded. What matters is that the arms 19 are lifted before insertion of the new reel, according to what is illustrated in the subsequent sequences.

Figure 9:
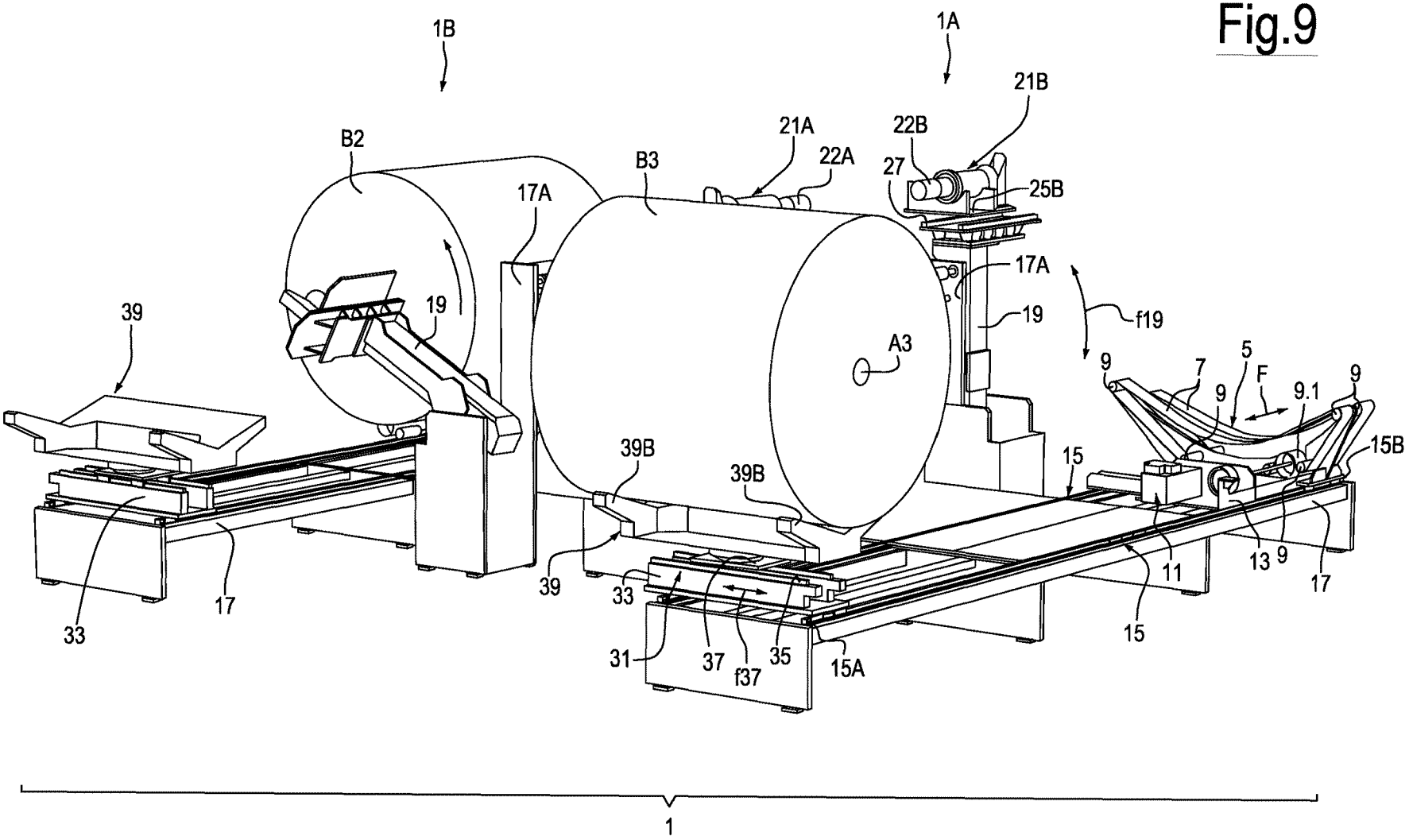

In FIG. 9 a new reel B3, wound on a winding rod A3, has been loaded onto the shuttle 31 while it is in its lateral loading and unloading position at the end 15A of the guides 15. The peripheral unwinding device 5 remains, in this step, in its lateral position on the opposite side of the unwinding station 1A.

Figure 10:
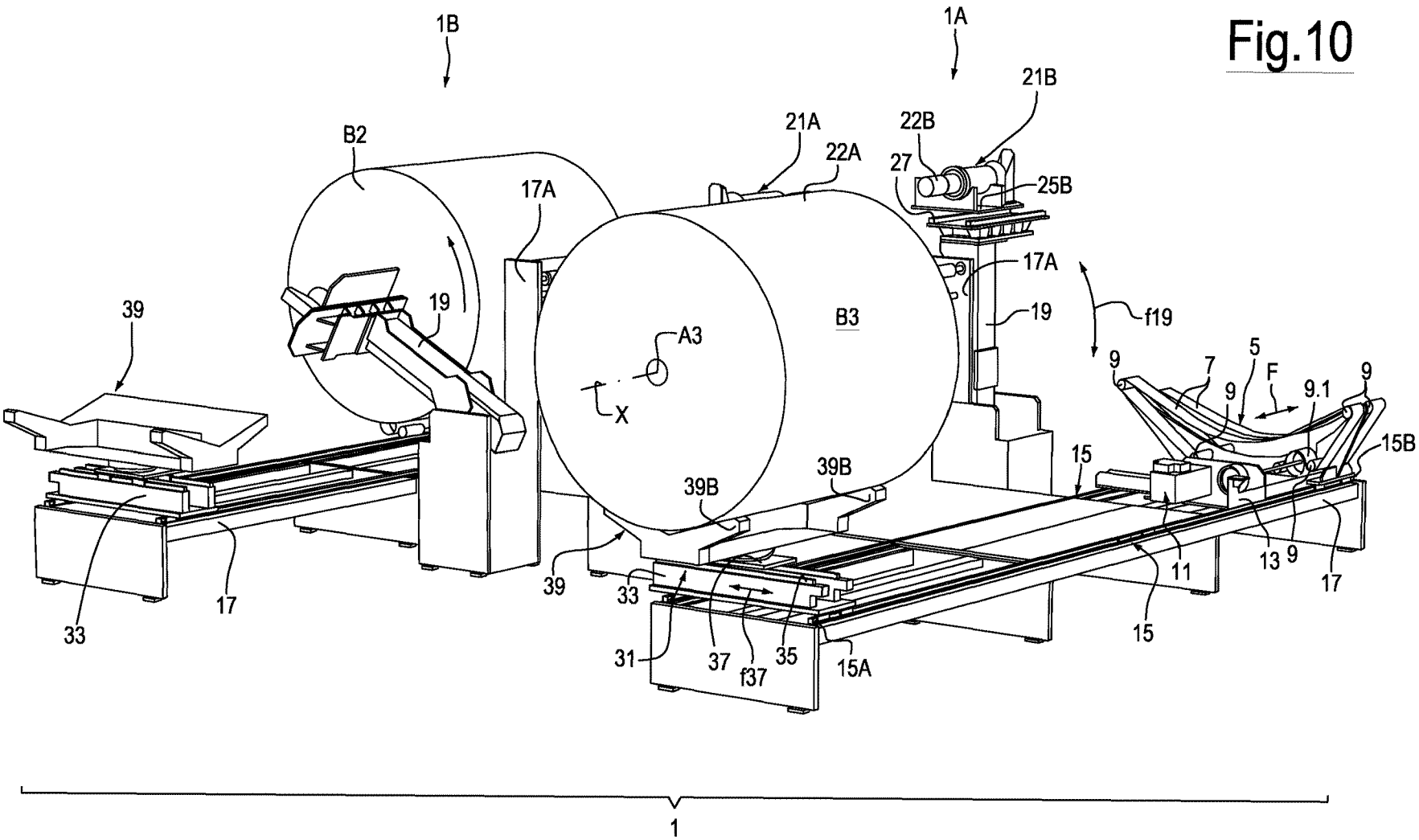
Figure 11:
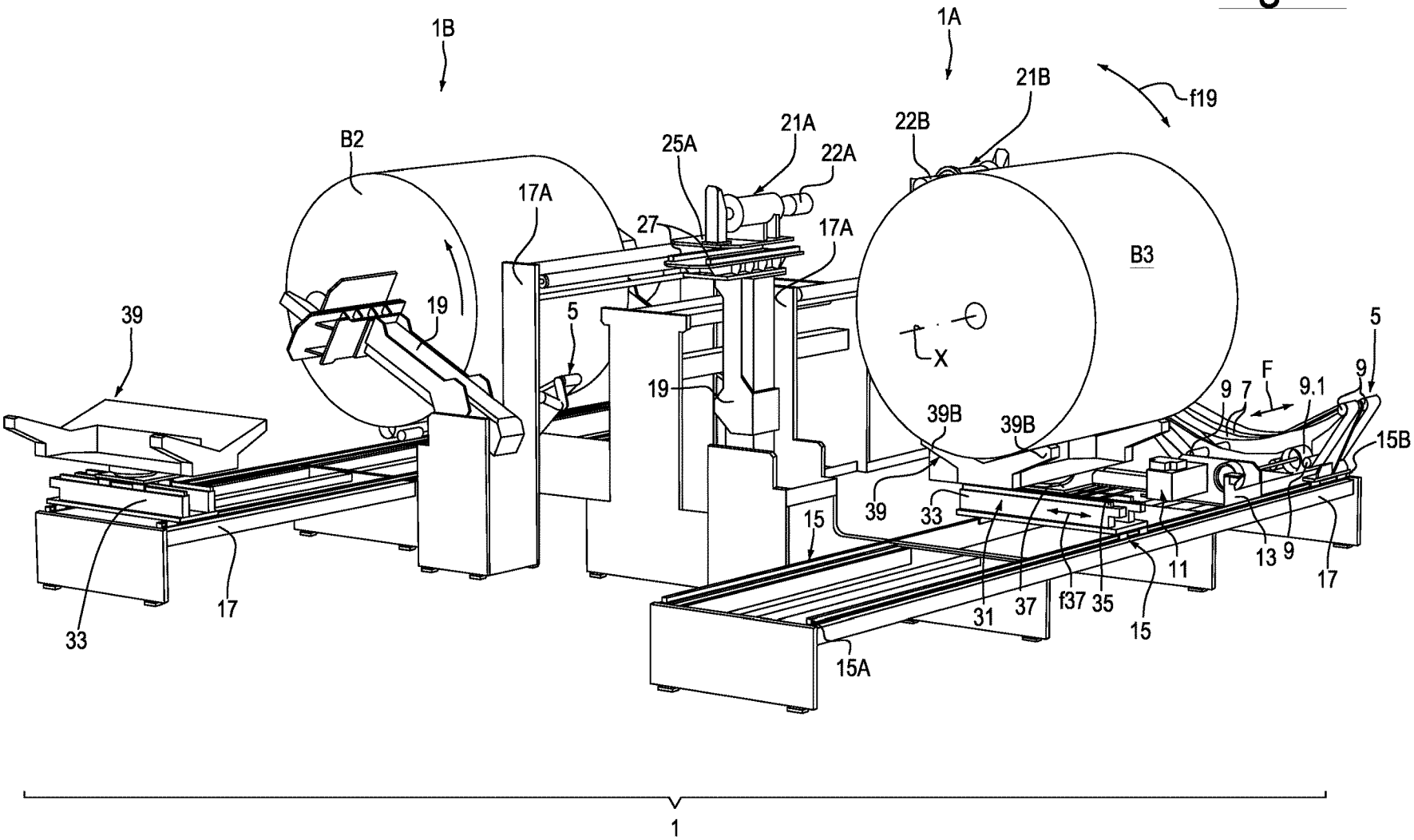

In the next FIG. 10 the shuttle 31 is in a position in which the cradle 39 is rotated about a vertical axis by 90° with respect to FIG. 9, to take the new reel B3 with its winding axis X-X in the direction parallel to the guides 15 and to the rotation axis of the tailstocks 21A, 21B. From this position the shuttle 31 can translate into the intermediate position shown in FIG. 11, where the new reel B3 is placed in an intermediate position between the arms 19.

Figure 12:
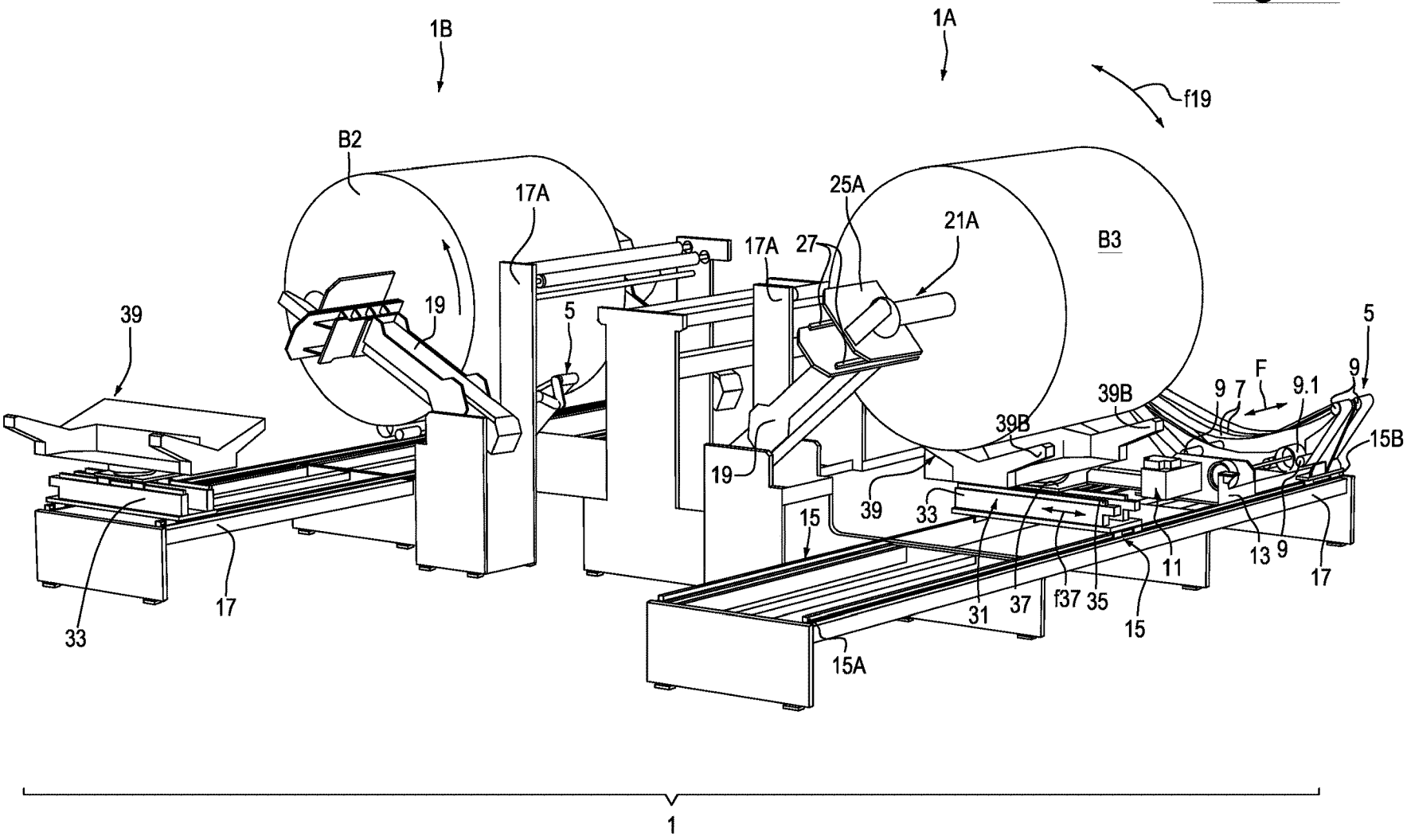

In FIG. 12 the arms 19 have been rotated downward according to arrow f19 to take the tailstocks 21A, 21B into alignment with the axis X-X of the reel B3. The position can be identified through suitable control means, such as a laser sensor, video cameras or the like, mounted on the tailstocks 21A, 21B. Therefore, centering of the tailstocks 21A, 21B with the axis X-X of the reel B3 is obtained by performing appropriate movements along the arrows f19, f37 and F, adjusting the mutual position of the arms 19 and of the cradle 39. In the event of a misalignment of the axis of the reel X-X with the tailstocks 21A, 21B it is possible to rotate the cradle 39 to return the reel to the correct orientation. During the lowering movement, the tailstocks 21A, 21B are spaced axially from each other, so that the torsional coupling members 22A, 22B do not impact against the reel B3 that is located on the shuttle 31. For this purpose, the slides 25A, 25B of the tailstocks 21A, 21B are held in their position of maximum mutual distance on the guides 27.

When the arms 19 have been rotated until the axes of the tailstocks 21A, 21B are taken into alignment with the axis X-X of the reel B3, the tailstocks 21A, 21B can be moved toward each other by inserting the torsional coupling members 22A, 22B into the hole of the winding rod A3. FIG. 12 shows the tailstocks in the position in which the torsional coupling members have already been inserted inside the respective ends of the rod A3.

Figure 13:
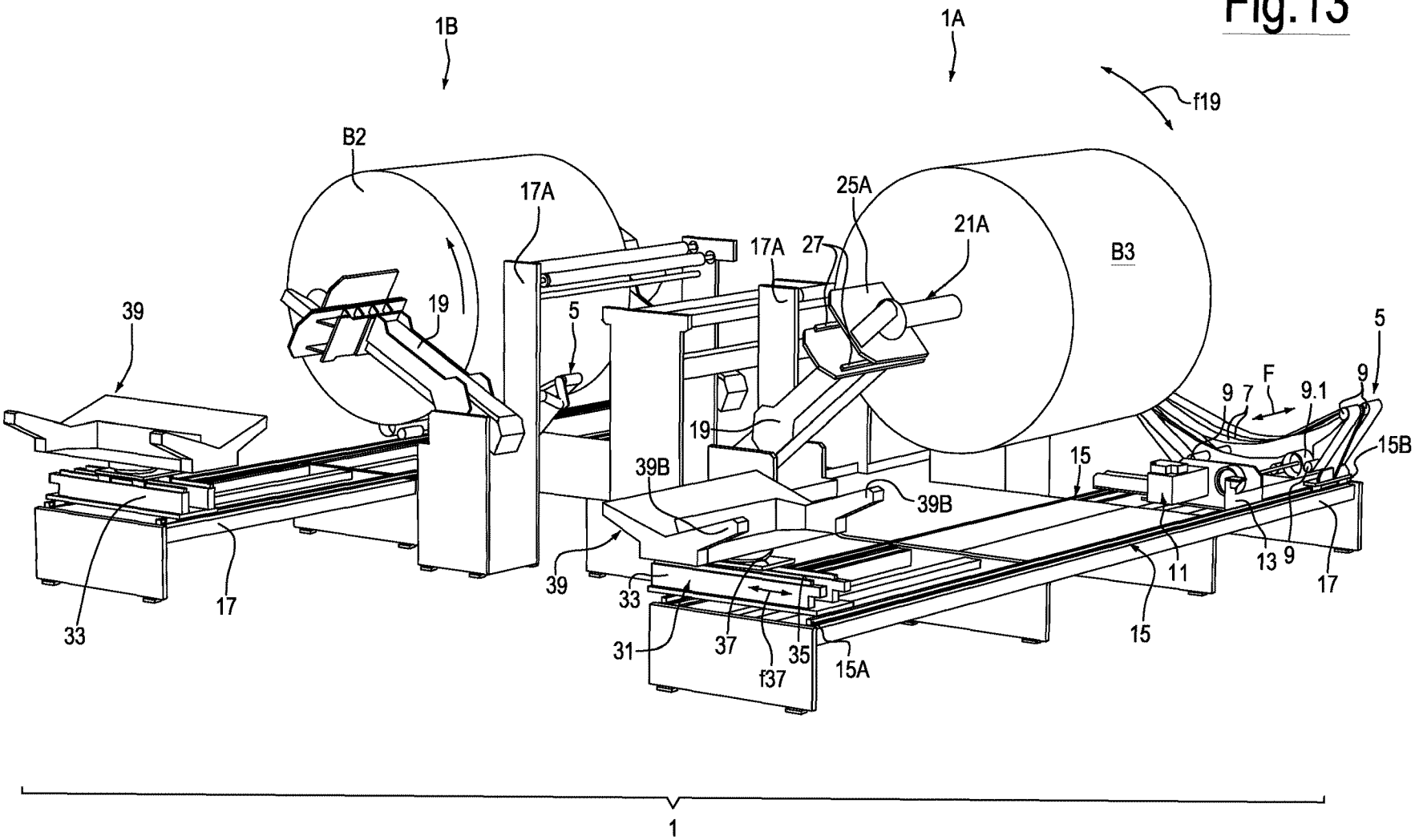

In the next FIG. 13 the reel B3 has been lifted with a rotation movement according to the arrow f19 by the arms 19, to move it away from the cradle 39 of the shuttle 31. In this way, the shuttle 31 can be moved once again according to the direction F into its loading and unloading position, at the end 15A of the guides 15. In this way, the space between the two arms 19 under the reel B3 is cleared so that the peripheral unwinding device 5, which until now was in its lateral withdrawn position at the end 15B of the guides 15, can once again be inserted therein.

Figure 14:
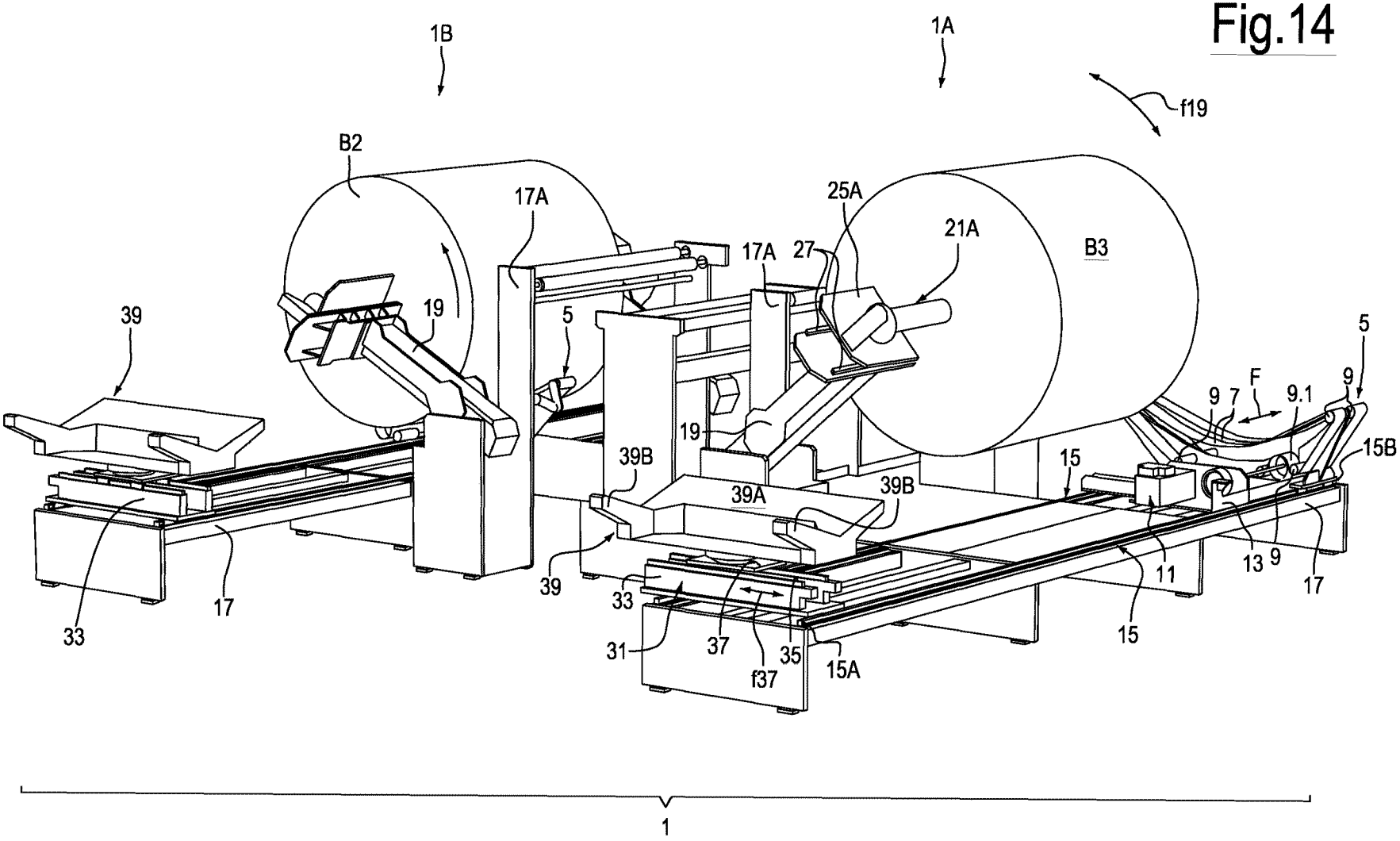

In FIG. 14 the shuttle 31 has been repositioned with the cradle 39 rotated by 90° so that the vertex of the "V" defined thereby is parallel to the guides 35 and orthogonal to the guides 15.

Figure 15:
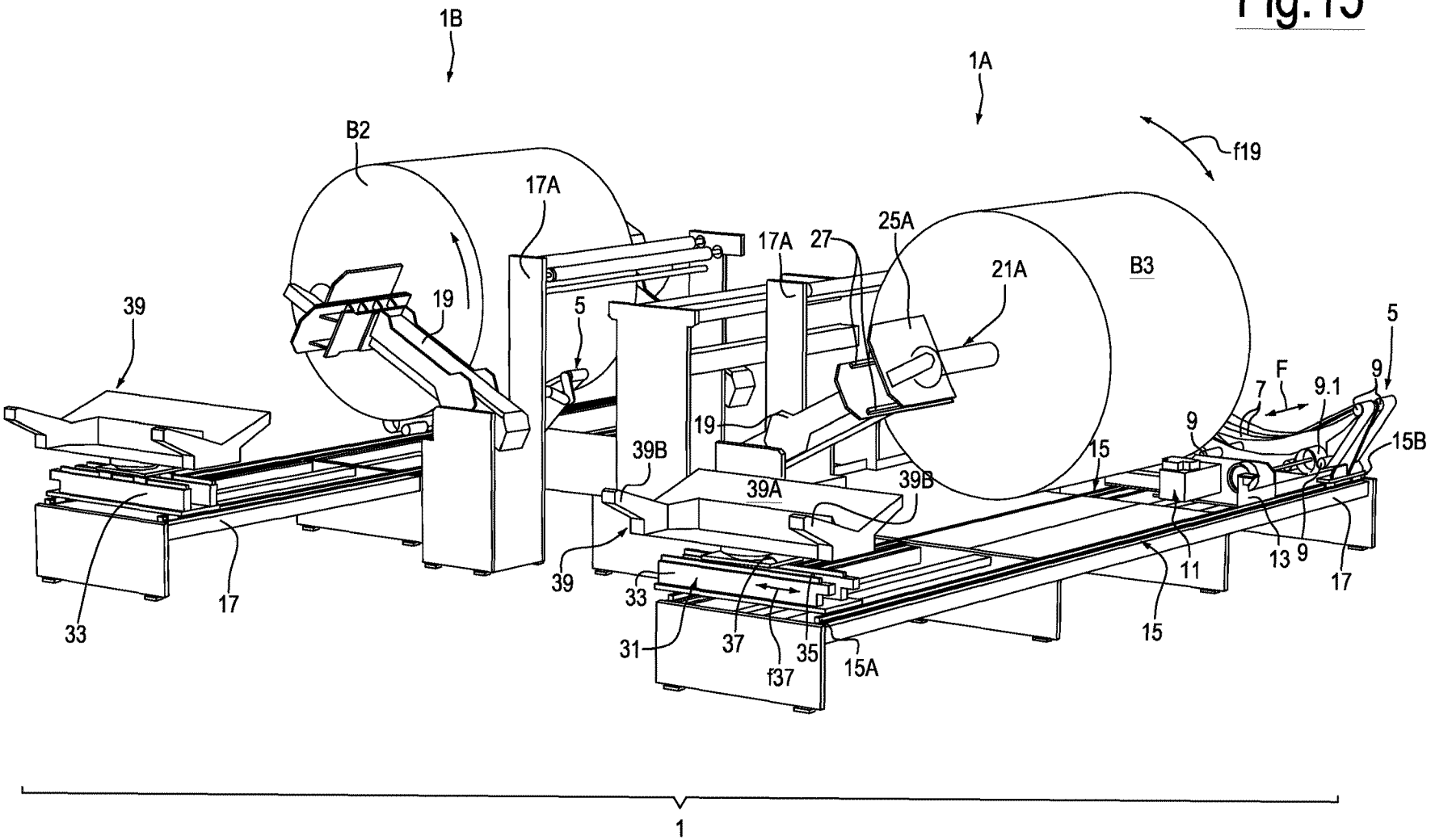

In FIG. 15 the peripheral unwinding device 5 has been returned to the central position of FIG. 2, and the reel B3 has been placed thereon through a downward rotation of the arms 19 according to the arrow f19. In this way, the outer cylindrical surface of the reel B3 is in contact with the belts 7 of the peripheral unwinding device 5 and, by activating the motor 11 of the peripheral unwinding device 5 and the motor 23 of the tailstock 21B, the reel B3 can be rotated when required, i.e., when it must replace the reel B2 located in the unwinding station 1B.

After reaching the condition of FIG. 15, an operator can easily prepare the leading edge of the web material wound on the reel B3 in the splicer 3 as shown for the web material N1 in FIG. 1, arranging the web material of the reel B3 to be subsequently spliced by the splicer 3 to the trailing edge of the web material N2 dispensed from the reel B2.

The sequences described above and shown in FIGS. 2 to 15 can be modified with respect to what is illustrated, for example as a function of the type of devices for loading the reels and unloading the winding rods onto and from the shuttle 31. In fact, in the sequence described above unloading of the winding rod A1 from the cradle 39 of the shuttle 31 and loading onto said cradle of the new reel B3 take place with a movement of the rod and of the reel in a direction orthogonal to the respective axis. This requires a rotation through 90° of the cradle 39 to be performed to take the winding rod A1 from the position in which it is in the unwinding step to the position for pick-up and removal from the cradle 39. Likewise, a reverse rotation is required to position it in the layout to be engaged by the tailstocks 21A, 21B.

Vice-versa, if the devices for loading and unloading rods and reels with respect to the shuttle 31 are provided with pins that are inserted into the hole of the winding rods, so as to be able to move the reels according to a direction parallel to said guides, the rotation of the cradle 39 about the vertical axis C-C is no longer necessary. Alternatively, if loading of the reels and unloading of the winding rods always takes place with the winding axis parallel to the guides 15 and to the axis of rotation of the tailstocks, it would be possible to use a shuttle in which the cradle 39 does not rotate about the vertical axis C-C.

The movement according to the double arrow f37 of the slide 37 on the guides 35 allows reels of different diameters to be handled, as by moving the arms 19 according to the arrow f19 and the cradle 31 in the direction of the double arrow f37 it is possible to center the tailstocks 21A, 21B with the winding axis of reels of different diameters. Alternatively, the cradle 39 can be devoid of the movement according to f37 and the tailstocks can be provided with a movement orthogonal to their axis of rotation and parallel to the development of the arms 19.

Unwinding of the reels of web material can take place in several ways: for soft reels with large diameters, for example reels of structured paper, both the peripheral unwinding device 5 and the central unwinding device could be used, at least initially, so that the use of the central unwinding device alone does not tend to "screw" the turns of paper about the axis of the reel and the use of the peripheral unwinding device alone does not make too many marks on the surface of the paper due to the greater torque to be transferred from the belts 7 to the outer surface of the reel. When the reel is about to come to an end, it is possible to continue to unwind the web material with the central unwinding device alone, shifting and subsequently moving away the peripheral unwinding device 5 toward the end 15B before the reel is emptied. For soft reels with small diameters the central unwinding device can instead be used alone. In other cases, preferably for compact reels, the peripheral unwinding device 5 can be used alone.

The invention claimed is:

1. An unwinder of reels of web material having at least one unwinding station, comprising:

a pair of tailstocks adapted to engage and support a reel to be unwound, wherein the tailstocks have respective rotation axes;

a peripheral unwinding device adapted to co-act with a reel in said unwinding station;

a shuttle adapted to insert reels into the unwinding station, wherein the shuttle is movable between a loading position of the reel on the shuttle and a position aligned with the pair of tailstocks, to transfer a reel from the shuttle to the tailstocks or vice versa;

wherein in use the peripheral unwinding device is positioned under the reel of web material, so that force exerted by the peripheral unwinding device on the reel being unwound has a component that is subtracted from a weight force of the reel, wherein the peripheral unwinding device is movable in a direction parallel to the rotation axes of the tailstocks, between an active position and an inactive position, wherein in the active position the peripheral unwinding device is positioned intermediate between the tailstocks and co-acts with a reel engaged by the tailstocks; and wherein in the inactive position the peripheral unwinding device is laterally staggered with respect to said tailstocks in a direction of the rotation axes of the tailstocks.

2. The unwinder of claim 1, wherein the shuttle and the peripheral unwinding device are movable in the same direction.

3. The unwinder of claim 2, wherein the shuttle and the peripheral unwinding device are movable along a common guide system parallel to the rotation axis of the tailstocks.

4. The unwinder of claim 2, wherein the shuttle and the peripheral unwinding device are movable in a direction parallel to the rotation axes of the tailstocks.

5. The unwinder of claim 2, wherein the loading position of the shuttle and the inactive position of the peripheral unwinding device are on opposite sides of the unwinding station.

6. The unwinder of claim 1, wherein the peripheral unwinding device comprises at least one flexible endless member adapted to partially surround the reel that is engaged between the tailstocks and guided around at least one motorized roller.

7. The unwinder of claim 1, wherein the tailstocks are movable between at least one pick-up position of the reel from the shuttle and an unwinding position.

8. The unwinder of claim 7, wherein the tailstocks are carried by arms rotating about an axis parallel to a rotation axis of the tailstocks.

9. The unwinder of claim 8, wherein an active position of the peripheral unwinding device is intermediate between said rotating arms and a withdrawn position is outside a volume comprising between trajectories of motion of the rotating arms.

10. The unwinder of claim 8, wherein the loading position of the shuttle is outside a volume comprising between trajectories of motion of the rotating arms.

11. The unwinder of claim 1, wherein the tailstocks have a lifting and lowering movement with respect to a sliding guide of the shuttle.

12. The unwinder of claim 1, wherein the shuttle comprises a cradle for receiving the reel, carried by a carriage.

13. The unwinder of claim 12, wherein the cradle is adapted to rotate with respect to the carriage about a vertical axis.

14. The unwinder of claim 12, wherein the cradle is adapted to translate with respect to the carriage, in a direction orthogonal to a direction of movement of the shuttle, to move toward and away from the tailstocks.

15. The unwinder of claim 1, wherein said at least one unwinding station comprises a first unwinding station and a second unwinding station with the second unwinding station being substantially symmetrical with respect to the first unwinding station.

16. The unwinder of claim 15, wherein between the first unwinding station and the second unwinding station a splicer is arranged, to splice a first web material coming from a first reel in one of said first unwinding station and said second unwinding station to a second web material coming from a second reel in another of said first unwinding station and said second unwinding station.

17. The unwinder of claim 15, comprising a feed path for the web material unwound from reels positioned in the first unwinding station and the second unwinding station, which extends at least in part under one of the first unwinding station and the second unwinding station.

18. The unwinder of claim 1, wherein at least one of the tailstocks is motorized; and wherein the tailstocks comprise torsional coupling members between the respective tailstock and a central rod of the reels.

19. An unwinder of reels of web material having at least one unwinding station, comprising:

a pair of tailstocks adapted to engage and support a reel to be unwound;

a peripheral unwinding device adapted to co-act with a reel in said unwinding station;

a shuttle adapted to insert reels into the unwinding station, movable between a loading position of the reel on the shuttle and a position aligned with the pair of tailstocks, to transfer a reel from the shuttle (31) to the tailstocks or vice versa;

wherein in use the peripheral unwinding device is positioned under the reel of web material, so that force exerted by the peripheral unwinding device on the reel being unwound has a component that is subtracted from a weight force of the reel, and wherein at least one of the tailstocks is motorized and wherein the tailstocks comprise torsional coupling members between a respective tailstock and a central rod of the reels.

20. A method for unwinding web material from a reel being unwound in an unwinding station, the method comprising steps of:

dispensing the web material from the reel being unwound engaged by a pair of tailstocks rotating around rotation axes of the tailstocks, maintaining the reel in rotation at least by a peripheral unwinding device in contact with a lateral surface of the reel being unwound and positioned in a position intermediate the tailstocks and under the reel, so as to apply on the reel a resultant force with a component opposing a weight force of the reel;

when the reel being unwound requires to be replaced, taking the reel out of contact with respect to the peripheral unwinding device and removing the peripheral unwinding device from the position intermediate the tailstocks in a withdrawn position with a motion of the peripheral winding device in a direction parallel to the rotation axes of the tailstocks;

arranging a shuttle at the tailstocks;

unloading the reel or a winding rod thereof from the tailstocks onto the shuttle;

moving the shuttle away from the tailstocks;

removing the reel once empty or rod thereof from the shuttle;

loading a new reel onto the shuttle;

translating the shuttle to the tailstocks;

engaging the new reel with the tailstocks;

lifting with the tailstocks the new reel from the shuttle;

moving the shuttle away from the tailstocks;

returning the peripheral unwinding device back in the intermediate position between the tailstocks; and taking the new reel into peripheral contact with the peripheral unwinding device.

21. The method of claim 20, wherein the step of dispensing the web material comprises transmitting a combined unwinding torque to the reel through the peripheral unwinding device and through at least one of said tailstocks.

22. The method of claim 20, wherein the shuttle is translated in a direction parallel to a rotation axis of the tailstocks.

* * * * *